US009792786B1

(12) United States Patent
Zhu et al.

(10) Patent No.: US 9,792,786 B1
(45) Date of Patent: Oct. 17, 2017

(54) DUAL MOUNT SEARCHABLE BINDER

(71) Applicants: Shengbo Zhu, San Jose, CA (US); Su Shiong Huang, Belleville, WA (US)

(72) Inventors: Shengbo Zhu, San Jose, CA (US); Su Shiong Huang, Belleville, WA (US)

(73) Assignee: MICRODATA CORPORATION, San Jose, CA (US)

( * ) Notice: Subject to any disclaimer, the term of this patent is extended or adjusted under 35 U.S.C. 154(b) by 0 days.

(21) Appl. No.: 14/999,447

(22) Filed: May 6, 2016

(51) Int. Cl.

| | |
|---|---|
| ***G08B 5/00*** | (2006.01) |
| ***G08B 5/36*** | (2006.01) |
| ***B42F 13/40*** | (2006.01) |
| ***B42F 15/00*** | (2006.01) |

(52) U.S. Cl.
CPC ..... *G08B 5/36* (2013.01); *B42F 13/40* (2013.01); *B42F 15/0094* (2013.01)

(58) Field of Classification Search
CPC ..... G08B 5/36; B42F 15/0094
USPC ..... 340/8.1, 825.36, 825.49, 570; 402/3; 211/42, 119.003, 153; 281/15.1; 235/385; 700/214, 220
See application file for complete search history.

(56) References Cited

U.S. PATENT DOCUMENTS

2011/0241890 A1* 10/2011 Zhu ..... G06Q 10/00 340/635
2012/0093569 A1* 4/2012 Zhu ..... B42F 13/40 402/3

* cited by examiner

*Primary Examiner* — Dhaval Patel

(57) ABSTRACT

A searchable binder which is operationally compatible with a binder management system having a cabinet with shelves or a file cabinet with file drawers for removable storage of searchable binders. Each binder has a body with front and rear covers and a spine. Inside the body is a binder mechanism for removably retaining sheet media. Each binder has a pair of binder contact mechanisms mounted to the spine at opposite ends, a binder identification circuit electrically coupled to the binder contact mechanisms, and a visible indicator. Each binder contact mechanism has a base element and a sliding element. The sliding element can be manually set to a retracted position in which the sliding element is extended a first distance and an extended position in which the sliding element is extended a second greater distance. In the retracted position, the sliding elements can make contact with conductive elements of a binder cabinet when a binder is placed on a shelf. In the extended position the sliding elements can make contact with conductive support rails of a file cabinet when a binder is placed in a file drawer. When a binder identification signal from a host computer is supplied to the conductive elements or the conductive rails. It is transferred by the binder contact mechanisms to the binder identification circuit. If the signal matches an address code stored in the binder identification circuit, the LED is activated to aid the user in finding the binder.

15 Claims, 9 Drawing Sheets

31
32
33
34
35
36
37
41
42
43
44
45
46
47
50
60

DUAL MOUNT SEARCHABLE BINDER

BACKGROUND OF THE INVENTION

This invention relates to documents management in general, and in particular to an improved documents management technique using a collection of searchable binders.

In medical records, legal and business offices, and some homes, notebook binders (hereinafter "binders") are typically used to store documents used for medical, legal, other business and personal purposes. A typical binder has a front cover, a rear cover and a spine joining the two covers. Inside the binder, a multi-ring manually operable binder mechanism having two or more two-piece arcuate rings is permanently mounted to facilitate insertion, storage and removal of documents having a number of holes formed along a mounting edge, with the number of holes corresponding to the number of rings of the binder mechanism. Each binder is typically removably supported on a shelf by placing the bottom edges of the binder covers and spine of a closed binder on the top surface of the supporting shelf. Several binders are typically installed on a given shelf, and several shelves are typically incorporated into a shelf support structure, such as a cabinet. In order to enable the documents contained in the various binders to be readily accessed, some type of documents management system is necessary.

Documents management is typically performed by binder management. Each document is initially assigned to, and placed in, an identified binder dedicated to documents of a particular subject matter (e.g., "utility bills for a specific account"). Later-generated related documents are typically assigned to and placed in this same binder. When a binder is filled to capacity by documents, a new binder is provided for receiving additional documents of the same category.

Binder management is typically conducted by providing each binder with a label in a location (usually somewhere on the spine of the binder) in which the label is visible when the binder is stored on a shelf. The label contains readable information describing the content of the binder. The readable information is typically a short form of identification, such as an account name, a subject name (e.g., "Bank Statements") or the like.

In order to provide ready access to the individual documents contained in the binders, some type of indexing arrangement is normally used to identify the location of each binder. A simple technique commonly employed is a manually prepared master list of all binders in the binder management system referencing each binder by the label information and noting the shelf and cabinet location of each binder. In large installations, more sophisticated indexing arrangements are used, such as a computer-based index listing all binders by a short form identifier and a corresponding enlarged and more thorough description of the binder contents. Even such computer-based arrangements still require the use of a readable label on each binder in order to identify a given binder to a user. This is highly undesirable, since it facilitates the search by any unauthorized user for a specific binder name or for a binder containing information of a particular type. Nevertheless, known binder management systems require the use of visible labels in order for the binders to be reasonably locatable.

In those applications in which several individuals have access to the binders, some arrangement is usually made to monitor the disposition of the binders. For example, in a business application, it is convenient and sometimes necessary to provide a sign out and return procedure so that the whereabouts of a given binder will always be known.

Usually, such monitoring attempts fail to accurately track the binders because of the failure of individuals to faithfully follow the procedure. Consequently, at any given time, the integrity of the binder management system can only be verified by actually looking through each shelf and comparing the binders and their contents with the master index. This requirement is both time-consuming and burdensome, and thus a severe disadvantage.

In known binder management systems of the type described above, once a binder is provided with a contents identifier, that binder is permanently associated with the nature of its contents. To change the contents to some other category, the binder must either be thrown away and a new, unmarked binder substituted in its place, or the identification label must be changed. In addition, the master index must be up-dated, either manually or by using the computer in a computer-based indexing system. These procedures are not always followed by office personnel, and the integrity of the binder system is consequently compromised.

In all examples of known binder management systems, the binders are usually provided with some type of human readable or machine readable identification indicia, such as the label affixed to the spine of each binder. In more sophisticated systems, a computer is used to assist in keeping track of the binders. When a binder is removed from the usual location, some procedure is typically available to note the fact that that binder has been removed from its normal location. This procedure normally relies on either manual entry of the change into the system computer by an operator, or the use of label reading devices (e.g., bar code readers) to enter the information into the system computer. Unfortunately, not all users follow the binder tracking procedure faithfully and the result is that many binders can be missing from their assigned shelf positions at any given time.

A further disadvantage with known binder management systems lies in the fact that it is unnecessarily time-consuming to visually locate a sought binder even if that binder is in its proper location. The user must visually scan the spine label of each binder on a given shelf in a given cabinet until the sought binder is visually identified by the label information. If the sought binder has been previously misplaced on the wrong shelf of the same cabinet, the user must then visually scan all binders on the other shelves of that same cabinet until the sought binder is visually identified. If, after visually scanning all binders on all shelves of the same cabinet, the sought binder has not been found the user has no other recourse than to continue the visual scanning process on binders on shelves in the other cabinets in the binder storage area until the sought binder is located or all binders on all shelves of all cabinets in the binder storage area have been visually scanned and the sought binder has still not been located.

U.S. Pat. No. 8,717,143 issued May 6, 2014 (hereinafter the '143 patent) discloses a searchable binder suitable for use in a binder management system which is devoid of the above-noted disadvantages and which enables quick and efficient location of binders In a document management system. More particularly, the binder management system has a cabinet with shelves for removable storage of searchable binders. Each binder has a body with front and rear covers and a spine. Inside the body is a binder mechanism for removably retaining sheet media. Each binder has externally extending upper and lower ohmic contact members which ohmically engage conductive members mounted on the shelf surfaces near the front when a binder is installed on a cabinet shelf. Each binder has a binder identification circuit coupled to an LED mounted on the binder spine in a location visible when the binder rests on a shelf. When a binder identification signal from a host computer is presented to the shelf conductive members it is transferred by the binder contact members to the binder identification circuit. If the binder identification signal matches a code stored in the binder identification circuit, the LED is activated to aid the user in finding the binder. An LED and an optional audible indicator are mounted on the shelves to further aid the user in finding the sought binder.

While the searchable binder described above represents a substantial improvement in the field of binder management systems, use thereof is limited to a binder management system having one or more cabinets provided with the conductive members mounted on the shelf surfaces near the front with which the upper and lower externally extending binder ohmic contact members can ohmically engage when a binder is installed on a given shelf. This unnecessarily limits the type of storage unit in which the searchable binder can be installed. In the past, ordinary binders have been stored in file cabinet drawers for future access. While searchable binders of the type described above can be physically stored in conventional file cabinet drawers, the search function will not be operable since the conventional file cabinet drawers do not have the structure required to transfer binder identification signals to the binder identification circuit in the searchable binder. This absence of the search function eliminates the advantages afforded by searchable binders.

Document management systems are known which provide a search function for documents removably contained in file folders. One example of such a document management system is disclosed in U.S. Pat. No. 8,525,674 issued Sep. 3, 2013 for "Collective Objects Management System With Object Identification Using Addressable Decoder Units", the disclosure of which is hereby incorporated by reference. The system disclosed in the '674 U.S. patent uses addressable decoder units to maintain control of all file folders in a collection. Each file folder has an associated addressable decoder unit (like the binder identification circuit) with a unique address in the file folder management system which responds to the receipt of that unique address from a source. The source is a local encoder in the file cabinet containing the addressed file, which generates the unique address in response to the receipt of a file folder identification signal from a remote host computer. Each file folder also has an indicator coupled to the decoder unit for identifying the file to a human operator. The indicator is preferably a visible indicator—such as an LED—coupled to the file folder in a convenient location which can readily be seen by a human operator when a file drawer is opened. Alternatively, an audible indicator—such as a buzzer—can be used.

Each file drawer has a plurality of mutually electrically isolated electrically conductive paths, at least one of which can receive address signals supplied by the source and specifying a sought file folder. The file folders positioned in the file drawers each has a plurality of electrically conductive members, each of which is electrically coupled to a different one of the plurality of mutually electrically isolated electrically conductive paths, an address decoder circuit carried by the file folder in the drawer, the address decoder circuit having a unique system address, the address decoder circuit further having a plurality of electrically conductive terminals in electrical contact with the plurality of electrically conductive members, and an indicator, such as a visible indicator (e.g., an LED) coupled to the address decoder circuit for activation whenever the address decoder circuit detects an address signal present on at least one of the plurality of electrically conductive members and representative of the unique system address of that file folder.

Each file cabinet includes an encoder for generating the address signals, the encoder having at least one input terminal for receiving file folder identification signals from a host computer, at least one output terminal coupled to each address decoder circuit of the plurality of file folders, and circuitry for generating a signal representative of the unique system address of the file folder specified by the file folder identification signals from the host computer.

Each file folder has a pair of support braces, with one of the support braces containing the plurality of electrically conductive members. The address decoder circuit and the indicator of each of the file folders are carried by one of the two support braces of each file folder.

The file folder drawer has a front panel with an additional indicator mounted thereon; and the system further includes circuitry for operating the additional indicator whenever an address decoder circuit located in the file folder drawer detects an address signal present on the at least one of the plurality of electrically conductive members and representative of the unique system address of that address decoder.

Each address decoder circuit includes circuitry for generating a VALID signal whenever that address decoder circuit detects an address signal present on the at least one of the plurality of electrically conductive members and representative of the unique system address of that address decoder circuit.

A microcomputer located in the file cabinet supplies power signals to the plurality of file folders via some of the electrically conductive paths, and address signals via the at least one of the electrically conductive paths; and receives VALID signals generated by each address decoder circuit when an incoming address matches a given address decoder circuit system address. The microcomputer also includes circuitry for generating information signals identifying the location in the system of any address decoder circuit which generates a VALID signal. These information signals are transmitted back to the host computer for the purpose of file folder management.

SUMMARY OF THE INVENTION

The invention comprises a searchable binder which is operationally compatible with both binder management systems having cabinets with shelves equipped with conductive members for transferring binder identification signals to the binder, and which is also operationally compatible with document management systems using file cabinets with file drawers having a plurality of mutually electrically isolated electrically conductive paths, at least one of which can transfer binder identification signals to the binder.

In a first aspect the invention comprises a searchable binder operationally compatible with a binder management system having a binder cabinet with conductive shelf elements and a file cabinet with conductive support rails, the binder comprising:

a binder body having a front cover, a rear cover and a spine joining the front cover and the rear cover, the spine having upper and lower outer margins;

a binder mechanism mounted in the interior of the binder body;

a visible indicator mounted on the binder body in a position visible from the outside of the binder;

a pair of binder contact mechanisms secured to the spine at opposite ends thereof, each binder contact mechanism having a base element and a sliding element slidably secured to the base element, the sliding element having a first stable position in which the sliding element extends a first distance beyond the associated one of the outer margins of the spine to enable engagement with one of the conductive shelf elements of the binder cabinet and a second stable position in which the sliding element extends a second distance beyond the associated one of the outer margins of the spine to enable engagement with one of the conductive support rails of the file cabinet, the conductive shelf elements and conductive support rails providing binder identification signals; and a binder identification circuit mounted on the binder body and coupled to at least one of the pair of binder contact mechanisms and the visible indicator for activating the visible indicator when a binder identification signal present on the at least one binder contact mechanism designates the binder as a sought binder.

The base element includes a pair of longitudinally spaced upstanding mutually aligned guide posts, an upstanding apertured guide flange having an aperture aligned with the guide posts, and a latch spring mounted adjacent an edge of the base element. The sliding element includes an outwardly extending contact flange located at a first end of the sliding element, a guide rod pivotally secured to a second opposite end of the sliding element and received in sliding engagement in the aperture of the guide flange, a bias spring received about the guide rod between the second opposite end of the sliding element and the guide flange of the base element, a longitudinally extending guide slot dimensioned to receive the pair of longitudinally spaced upstanding mutually aligned guide posts of the base element, and a latching notch formed in an edge of the sliding element in a position to engage the latch spring of the base element when the sliding element is in the first stable position. One of the pair of mutually aligned guide posts has a smaller outer diameter than the other one of the mutually aligned guide posts so that the sliding element is capable of limited lateral movement sufficient to disengage the latch spring from the latching notch when the sliding element is subjected to a laterally directed force.

In the preferred embodiment, the guide rod is pivotally secured to the second opposite end of the sliding element by means of an apertured mounting tab secured to the guide rod and a rivet received in the aperture in the mounting tab.

The invention preferably includes a mounting plate mounted on the spine; and the pair of binder contact mechanisms and the binder identification circuit are carried by the mounting plate.

In another aspect, the invention comprises a searchable binder module for use with a binder body having a front cover, a rear cover and a spine joining the front cover and the rear cover, the spine having upper and lower outer margins, the module comprising:

a mounting plate dimensioned to be mounted on a binder body spine;

a visible indicator secured to the mounting plate;

a pair of binder contact mechanisms secured to the mounting plate at opposite ends thereof, each binder contact mechanism having a base element and a sliding element slidably secured to the base element, the sliding element having a first stable position in which the sliding element extends a first distance beyond an associated one of the outer margins of the binder body spine when the mounting plate is mounted on the binder body spine and a second stable position in which the sliding element extends a second distance beyond the associated one of the outer margins of the binder body spine when the mounting plate is mounted on the binder body spine; and a binder identification circuit mounted on the mounting plate and coupled to at least one of the pair of binder contact mechanisms and the visible indicator for activating the visible indicator when a binder identification signal present on the at least one binder contact mechanism designates the binder as a sought binder.

The base element includes a pair of longitudinally spaced upstanding mutually aligned guide posts, an upstanding apertured guide flange having an aperture aligned with the guide posts, and a latch spring mounted adjacent an edge of the base element. The sliding element includes an outwardly extending contact flange located at a first end of the sliding element, a guide rod pivotally secured to a second opposite end of the sliding element and received in sliding engagement in the aperture of the guide flange, a bias spring received about the guide rod between the second opposite end of the sliding element and the guide flange of the base element, a longitudinally extending guide slot dimensioned to receive the pair of longitudinally spaced upstanding mutually aligned guide posts of the base element, and a latching notch formed in an edge of the sliding element in a position to engage the latch spring of the base element when the sliding element is in the first stable position. One of the pair of mutually aligned guide posts has a smaller outer diameter than the other one of the mutually aligned guide posts so that the sliding element is capable of limited lateral movement sufficient to disengage the latch spring from the latching notch when the sliding element is subjected to a laterally directed force.

In the preferred embodiment, the guide rod is pivotally secured to the second opposite end of the sliding element by means of an apertured mounting tab secured to the guide rod and a rivet received in the aperture in the mounting tab.

In both aspects of the invention described above, the binder identification signal comprises a binder address unique to an associated binder body; and the binder identification circuit includes an addressable decoder.

In still another aspect, the invention comprises a contact mechanism for use with a binder body having a front cover, a rear cover and a spine joining the front cover and the rear cover, the spine having upper and lower outer margins, the contact mechanism comprising:

a base element having a pair of longitudinally spaced upstanding mutually aligned guide posts, an upstanding apertured guide flange having an aperture aligned with the guide posts, and a latch spring mounted adjacent an edge of the base element; and a sliding element slidably secured to the base element, the sliding element having a first stable position in which the sliding element extends a first distance beyond an associated one of the outer margins of the binder body spine when the contact mechanism is mounted on the binder body spine and a second stable position in which the sliding element extends a second distance beyond the associated one of the outer margins of the binder body spine when the contact mechanism is mounted on the binder body spine.

The sliding element includes an outwardly extending contact flange located at a first end of the sliding element, a guide rod pivotally secured to a second opposite end of the sliding element and received in sliding engagement in the aperture of the guide flange, a bias spring received about the guide rod between the second opposite end of the sliding element and the guide flange of the base element, a longitudinally extending guide slot dimensioned to receive the pair of longitudinally spaced upstanding mutually aligned guide posts of the base element, and a latching notch formed in an edge of the sliding element in a position to engage the latch spring of the base element when the sliding element is in the first stable position.

One of the pair of mutually aligned guide posts has a smaller outer diameter than the other one of the mutually aligned guide posts so that the sliding element is capable of limited lateral movement sufficient to disengage the latch spring from the latching notch when the sliding element is subjected to a laterally directed force.

In the preferred embodiment, the guide rod is pivotally secured to the second opposite end of the sliding element by means of an apertured mounting tab secured to the guide rod and a rivet received in the aperture in the mounting tab.

As with the '143 patent binder management system, to find a searchable binder an operator may enter the appropriate binder information into a host computer, which can perform a table look-up for the binder identification information—i.e. system address, and transmit this information to all binder cabinets and file cabinets. When a binder identification signal is matched to a binder by the binder identification circuit, the visible indicator on the corresponding binder is activated and the user can visually identify the binder being sought. In addition, for large or brightly lit binder storage areas activation of the visible indicators and the optional audible indicators assist the user in locating the sought binder.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
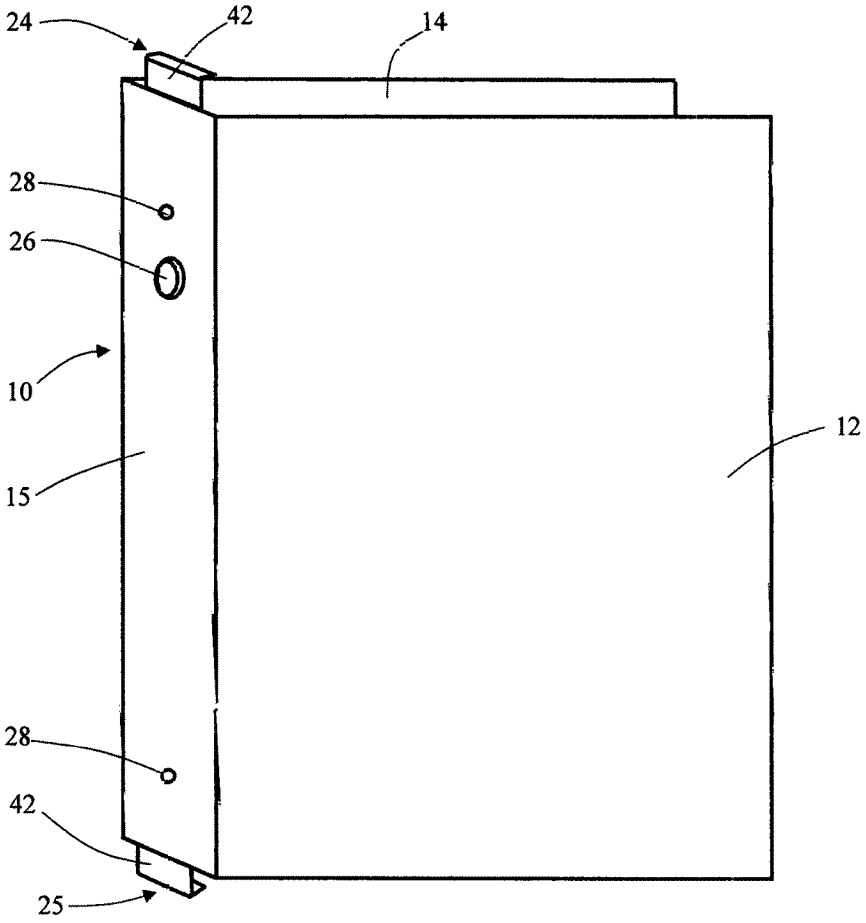
FIG. 1 is a perspective view of a binder according to the invention.
Figure 2:
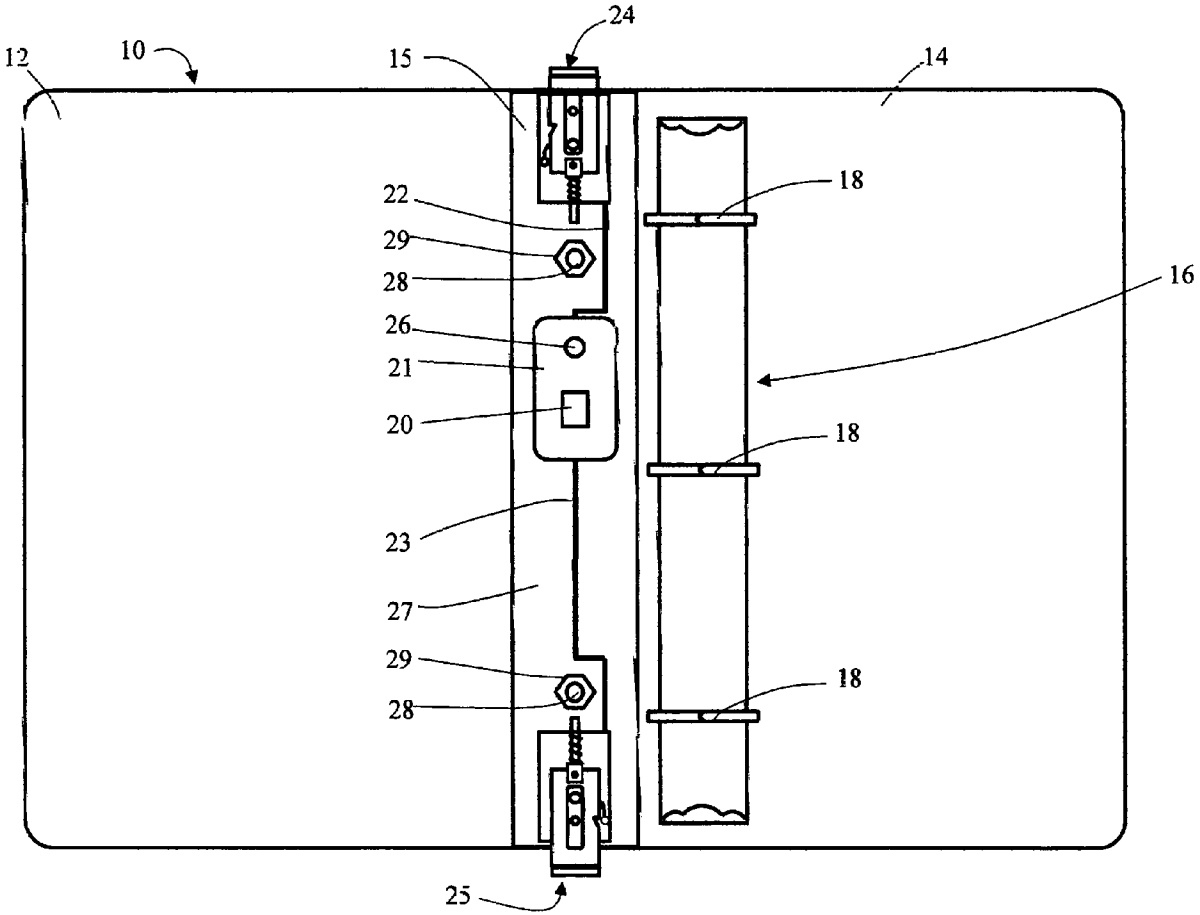
FIG. 2 is a plan view of the binder of FIG. 1 in the opened position.

FIGS. 1 and 2 illustrate a representative embodiment of a single binder according to the invention. As seen in these FIGS., a binder 10 has a front cover 12, a back cover 14 and a spine 15 joining the front and back covers 12, 14. A conventional multi-ring manually operable binder mechanism 16 having a plurality (3 illustrated) of two-piece arcuate rings 18 is permanently mounted to the inner face of rear cover 14 to facilitate insertion, storage and removal of documents having a number of holes formed along a mounting edge, with the number of holes corresponding to the number of rings 18 of the binder mechanism 16. Mounted on the inner surface of spine 15 are a binder identification circuit 20 carried by a substrate 21, a pair of ohmic conductors 22, 23, an upper binder contact mechanism 24, a lower binder contact mechanism 26, and a visible indicator 26, preferably an LED. Visible indicator 26 is located in an opening formed in spine 15 so as to be visible from the outer side of binder 10. Upper and lower binder contact mechanisms 24, 25 are ohmically connected to ohmic conductors 22, 23, respectively Binder identification circuit 20, substrate 21, ohmic conductors 22, 23, upper binder contact mechanism 24, lower binder contact mechanism 25 and visible indicator 26 are all preferably mounted on a unitary mounting plate 27 which is secured to the inner surface of binder spine 15 by suitable fasteners, such as machine screws 28 and nuts 29 or rivets. As illustrated, unitary mounting plate 27 is dimensioned to be conformable with the geometry of spine 15 so as to be accommodated thereby. Upper and lower binder contact mechanisms 24, 25 are arranged with respect to spine 15 with a slidable one of the elements thereof in a position extending outwardly of the upper and lower margins of spine 15 as shown. Each binder contact mechanism 24, 25 is spring loaded in the manner described below to promote sliding engagement with conductive strips which are carried by binder support shelves in the binder storage cabinet in which the binder 10 can be installed. This arrangement enables the upper and lower binder contact mechanisms 24, 25 to ohmically engage conductive strips mounted on the shelves on which the binder 10 can be removably stored. Thus, when a binder identification signal from a host computer is presented to the shelf conductive members it is transferred by the binder contact mechanisms 24, 25 to the binder identification circuit 20 via ohmic conductors 22, 23. If the received binder identification signal matches a code stored in the binder identification circuit 20, visible indicator 26 is activated by the binder identification circuit 20 to aid the user in locating the binder 10.

Figure 3:
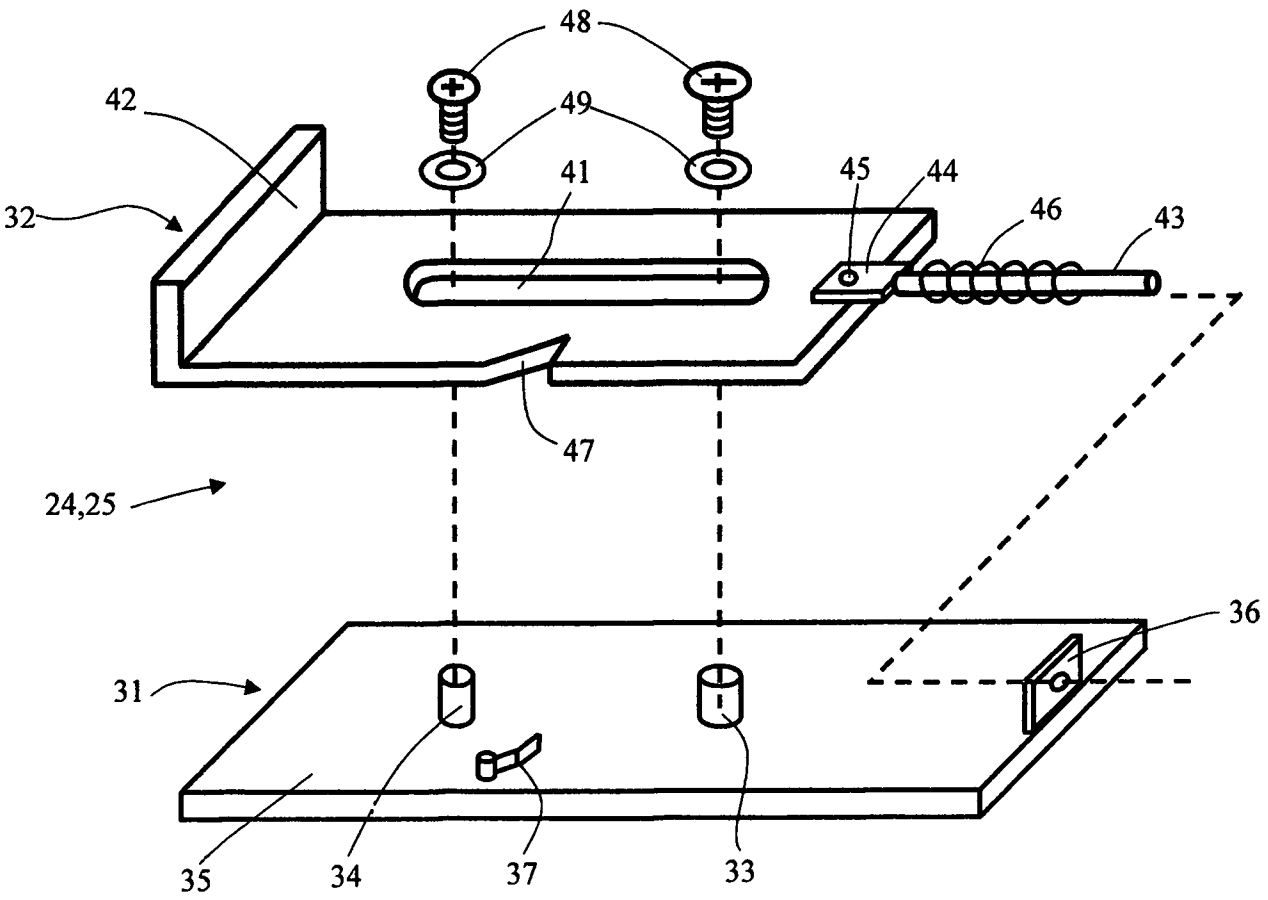
FIG. 3 is a schematic perspective assembly view of a single binder contact mechanism according to the invention.

With reference to FIG. 3, binder contact mechanisms 24, 25 are identical in structure and function and each comprises a stationary base element 31, which is secured to unitary mounting plate 27, and a sliding element 32, which is slidably mounted on base element 31. Base element 31 has a pair of guide posts 33, 34 extending outwardly from the surface of a support base 35. Guide posts 33, 34 are aligned along a longitudinal axis which passes through the center of an apertured guide flange 36 secured to one end of support base 35. A latch spring 37 is also secured to support base 35 for a purpose described below.

Sliding element 32 has a centrally located guide slot 41 extending longitudinally thereof for receiving guide posts 33, 34 when base element 31 and sliding element 32 are assembled together. Sliding element 32 has an outwardly extending contact flange 42 at a first end thereof, and a guide rod 43 extending from the second end thereof, the guide rod 43 being positioned and dimensioned to be slidingly accommodated by the aperture in guide flange 36 of base element 31. Guide rod 43 is attached to a mounting tab 44, which is pivotally mounted to the inner end of sliding element 32 by a rivet 45. A bias spring 46 provides a bias force between sliding element 32 and base element 31 when the two elements are assembled together in order to urge sliding element 32 to the left in FIG. 3. A latching notch 47 is formed along one edge of sliding element 32 and functions in the manner described below.

To assemble the binder contact mechanisms 24, 25, bias spring 46 is maneuvered onto guide rod 43 and the free end of guide rod 43 is maneuvered into the aperture of guide flange 36 until guide slot 41 is in registration with guide posts 33, 34. Sliding element 32 is next manipulated downwardly onto base element 31 while latch spring 37 is held in an outward position so as not to engage the edge of sliding element 32 containing latching notch 47. When the under surface of sliding element 32 engages the confronting upper surface of base element 31, latch spring 37 can be released to engage the confronting edge of sliding element 32 and sliding element 32 can be secured to base element 31 by installing threaded keeper elements 48 and spacer washers 49 into threaded apertures formed in guide posts 33, 34.

Figure 4:
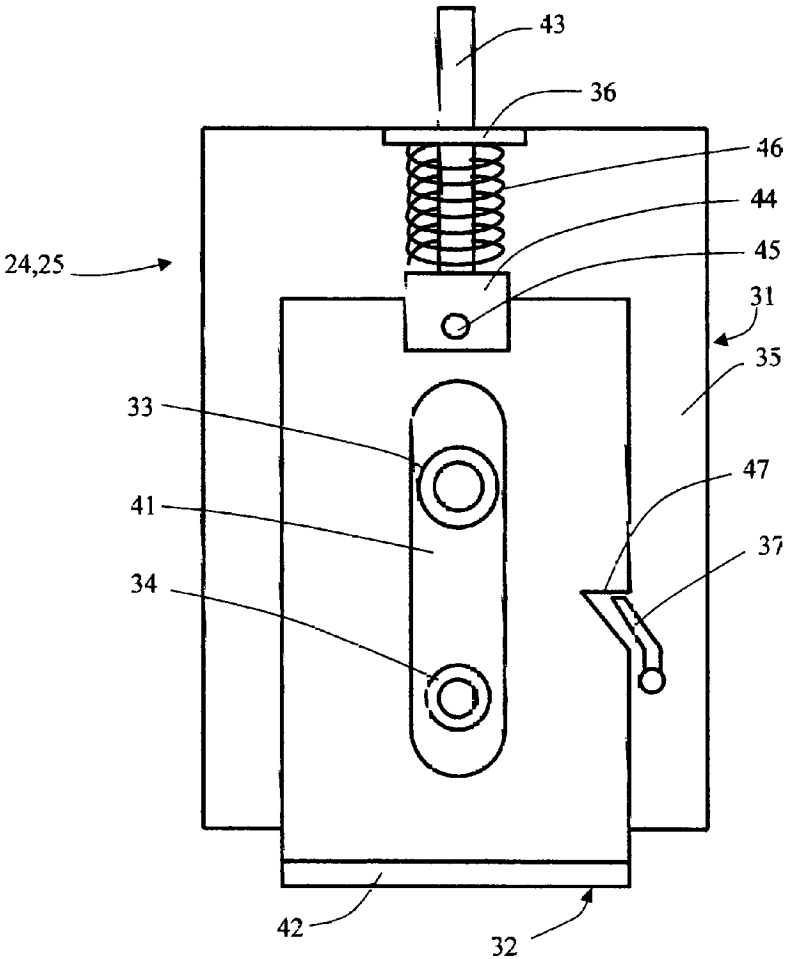
FIG. 4 is a front elevational view of the single binder contact mechanism of FIG. 3 in the retracted position.
Figure 5:
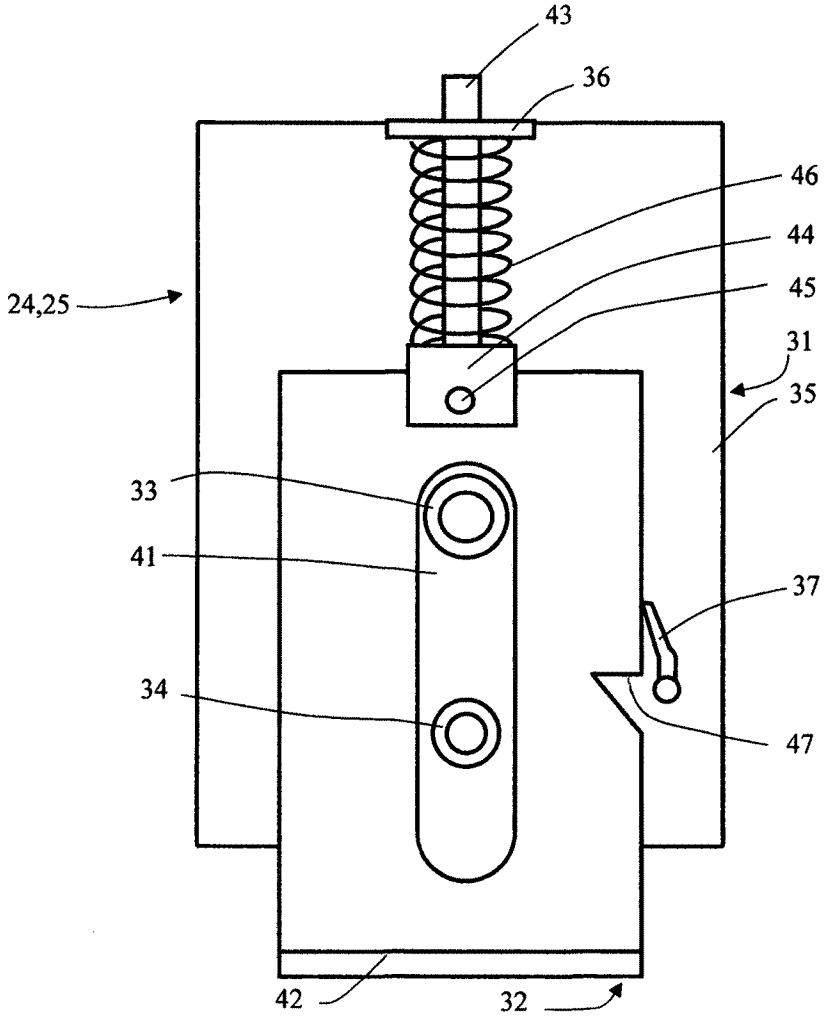
FIG. 5 is a front elevational view of the single binder contact mechanism of FIG. 3 in the extended position.

FIGS. 4 and 5 are front elevational views of the single binder contact mechanism 24, 25 of FIG. 3 illustrating the binder mechanism in the retracted position (FIG. 4) and in the extended position (FIG. 5). As seen in FIG. 4, when in the retracted position outward movement of binder sliding element 32 is limited by the engagement between latch spring 37 and latching notch 47. Inward movement of sliding element 32 is permitted by an amount equal to the distance between guide post 34 and the lower surface of guide slot 41. The retracted position shown in FIG. 4 is the position selected when the associated binder is to be installed on a cabinet shelf. As seen in FIG. 5, when in the extended position outward movement of binder sliding element 32 is limited by the engagement between guide post 33 and the upper surface of guide slot 41. Latch spring 37 is slidably engaged with the confronting edge of sliding element 32. Bias spring 46 ensures that sliding element 32 is extended the maximum amount permitted by the design. The extended position shown in FIG. 5 is the position selected when the associated binder is to be installed in a file cabinet drawer.

Figures 6A, 6B, 6C:
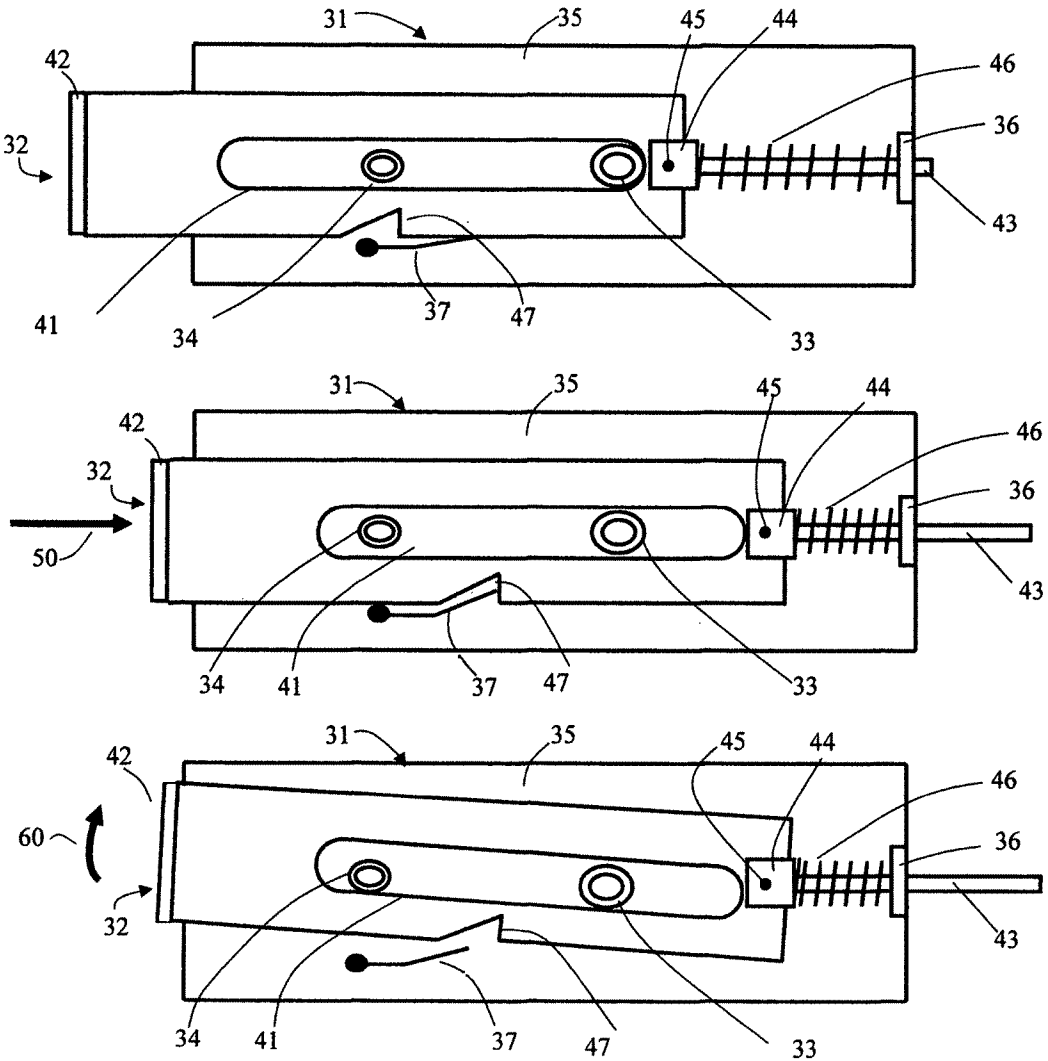
FIGS. 6A-C are schematic sequential views illustrating operation of the single binder contact mechanism between the retracted and extended positions.

FIGS. 6A-6C illustrate operation or the single binder contact mechanism between the retracted and extended positions. FIG. 6A illustrates the binder contact mechanism in the extended position in which sliding element 32 is urged to the outermost position permitted by the design. FIG. 6B illustrates the binder mechanism in the retracted position in which outward movement of the sliding element 32 is limited by the engagement between latch spring 37 and latching notch 47. This position is achieved by applying manual force in the direction of arrow 50 (i.e. inwardly of the mechanism when mounted to a binder) until latch spring 37 engages latching notch 47. FIG. 6C illustrates the manner in which sliding element 32 is maneuvered to release latch spring 37 from latching notch 47 in order to enable sliding element 32 to achieve the extended position of FIG. 6A. This is done by applying a laterally directed manual force to the outer end of sliding element 32 as indicated by arrow 60 which enables pivotal movement of sliding element 32 about guide post 33 until latch spring 37 is clear of latching notch 47. At this position sliding element 32 is free to be extended outwardly under the influence of bias spring 46 until sliding element 32 reaches the fully extended position. In order to enable the pivotal movement of sliding element 32, the outer diameter of guide post 34 is selected to be sufficiently less than the outer diameter of guide post 33 so that the amount of lateral excursion of sliding element 32 required to ensure that latch spring 37 clears latching notch 47 is achieved. Selection of the actual dimensions is well within the skill of the ordinary artisan in the art. During pivotal movement of sliding element 32 about guide post 33, mounting tab 44 pivots about rivet 45 so that guide rod 43 does not bind in the aperture in guide flange 36.

Figure 7:
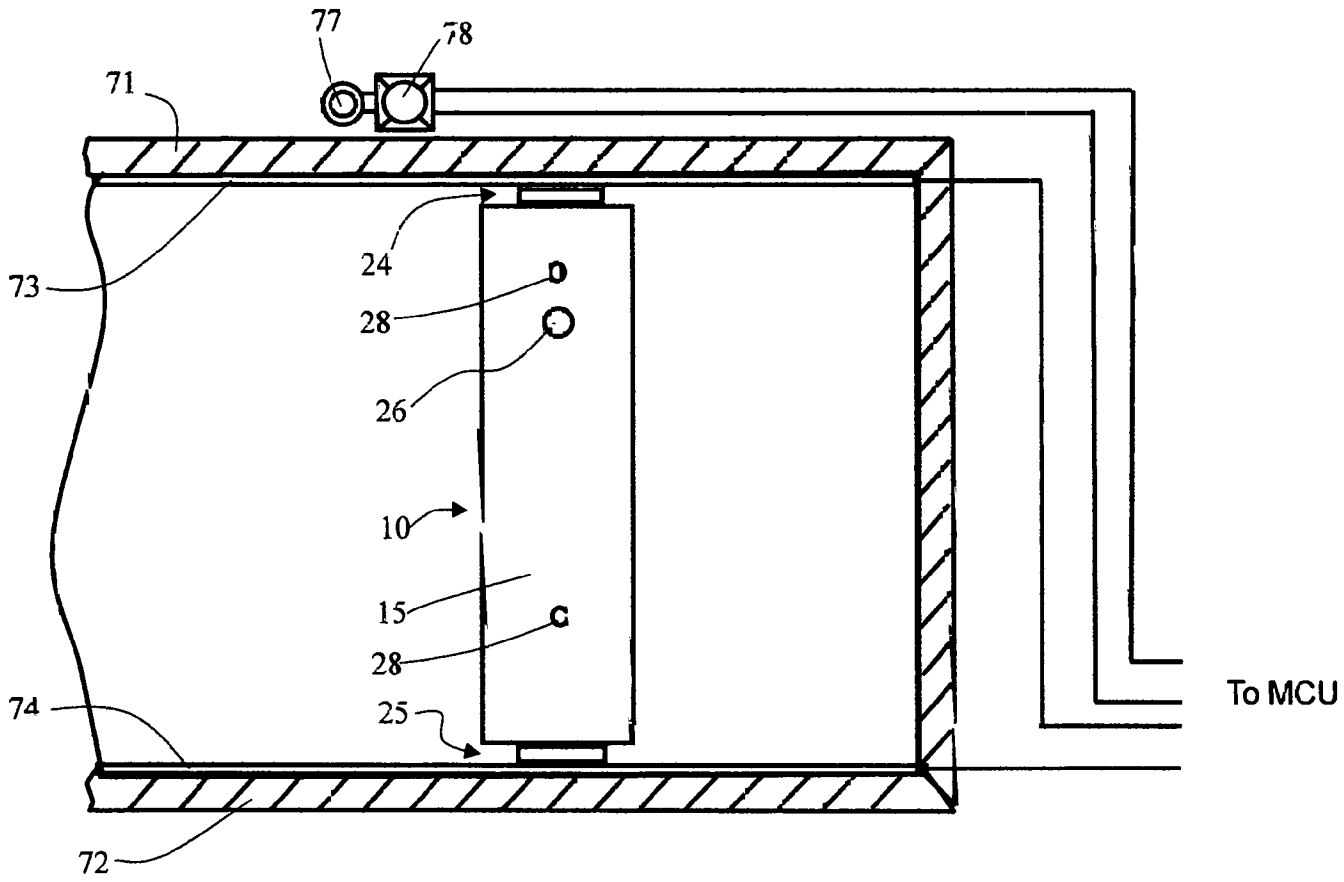
FIG. 7 is a front elevational view of a portion of a binder storage cabinet illustrating a single binder installed in the cabinet.

FIG. 7 is an enlarged partial front schematic view of a portion of a binder storage cabinet 70 including a top shelf 71 and a middle shelf 72 and illustrating a single binder 10 installed between shelves 71, 72. As seen in this FIG., a first laterally extending ohmically conductive strip 73 is mounted to the undersurface of top shelf 71, and a second laterally extending ohmically conductive strip 74 is mounted to the top surface of underlying shelf 72. The position of each conductive strip 73, 74 is chosen such that the upper and lower flanges 42 of binder contact mechanisms 24, 25 will engage the conductive strips 73, 74 so as to make ohmic contact therewith whenever a binder 10 is installed on underlying shelf 72. Conductive strips 73, 74 are electrically connected to data input and output terminals of a local cabinet microcomputer (not illustrated), such as a type AT89C2051 device available from Intel Corporation of Santa Clara, Calif. or a type LPC 1766 available from NXP Semiconductors of Eindhoven, The Netherlands. The local cabinet microcomputer generates the binder identification signals identifying a sought binder and these signals are coupled to the binder identification circuit 20 in binder 10 via conductive strips 73, 74, binder contact mechanisms 24, 25 and ohmio conductors 22, 23 within binder 10. A visible shelf indicator 77 and an optional cabinet audible indictor 78 are also coupled to appropriate control output terminals of the local cabinet microcomputer of each shelf pair to be activated by the local cabinet microcomputer whenever a sought binder 10 is located on a shelf. Before installing a binder 10 on a cabinet shelf, such as shelf 72, binder contact mechanisms 24, 25 are maneuvered to the retracted position in which the distance between the flanges 42 of the sliding elements 32 is essentially equal to the vertical distance between conductive strips 73, 74 of the cabinet shelves so that the flanges 42 make effective contact with the conductive strips 73, 74.

Figure 8:
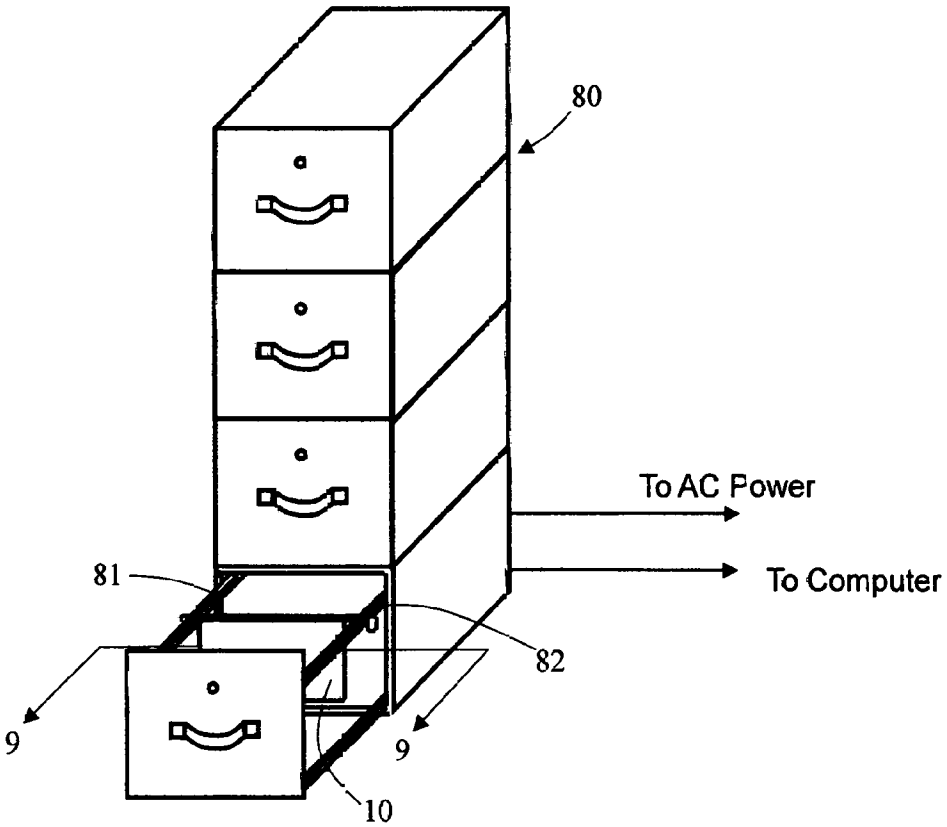
FIG. 8 is a perspective view of a file cabinet containing a single binder in a file drawer.
Figure 9:
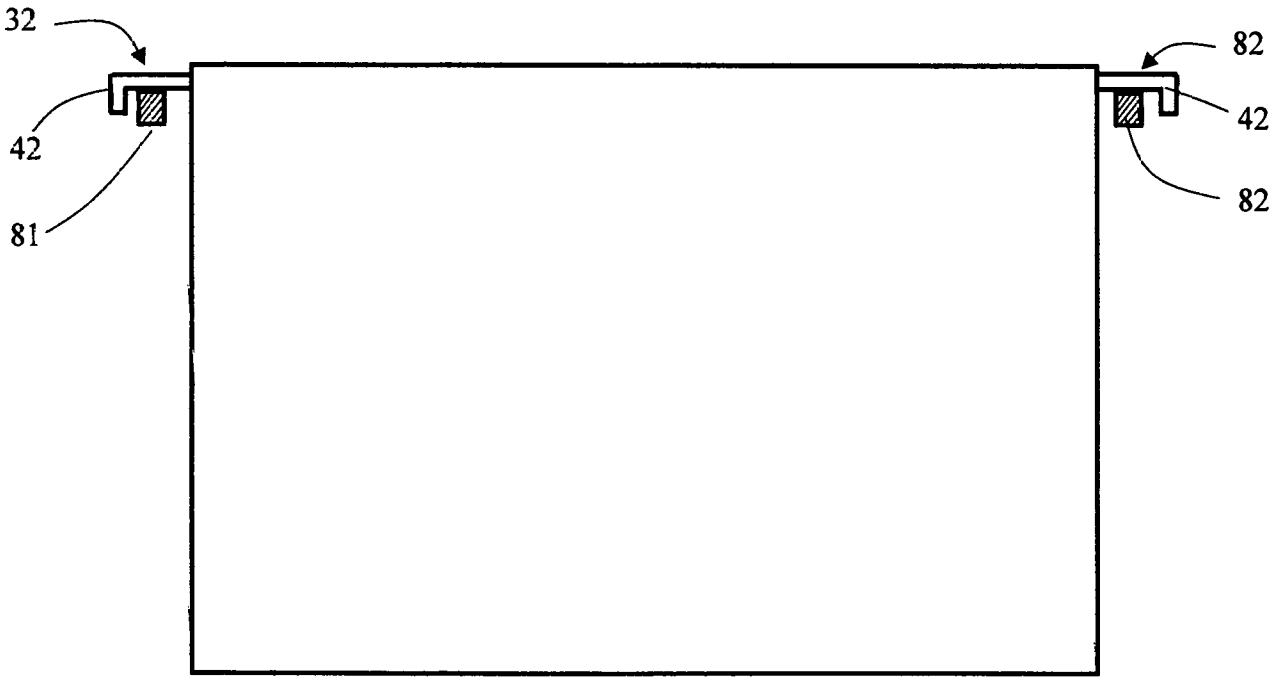
FIG. 9 is a view taken along lines 9-9 of FIG. 8 illustrating the single binder supported in the file drawer.

FIGS. 8 and 9 illustrate use of the binder 10 in a file cabinet. FIG. 8 is a perspective view of a file cabinet 80 containing a single binder 10 in a file drawer, and FIG. 9 is a view taken along lines 9-9 of FIG. 8 illustrating the single binder supported in the file drawer. File cabinet 80 is a standard file cabinet configured to function in a file management system of the type described in the above-referenced '674 U.S. patent. Consequently, the laterally spaced support rails 81, 82 can function to provide binder identification signals to any binder 10 installed in a drawer with the sliding element 32 of each binder contact mechanism 24, 25 in mechanical and electrical contact with the support rails 81, 82. Before installing a binder 10 in a drawer of a file cabinet 80, binder contact mechanisms 24, 25 are maneuvered to the extended position in which the distance between the flanges 42 of the sliding elements 32 is slightly greater than the lateral distance between the outer surfaces of the support rails 81, 82 so that the sliding elements 32 make effective contact with the support rails 81, 82.

As will now be apparent, binders provided with binder contact mechanisms fabricated in accordance with the invention are capable of more versatile use than known binders. In particular, such binders are operationally compatible with both binder cabinets and file cabinet drawers incorporating a binder search capability. Thus, such binders can be removably stored in either a searchable binder cabinet or a searchable file cabinet drawer without sacrificing the searchable binder capability. Moreover, the invention can be retrofitted to existing binders to provide the enhanced capability afforded by the invention by simply mounting the new elements on the spine of an existing conventional binder.

Although the above provides a full and complete disclosure of the preferred embodiments of the invention, various modifications, alternate constructions and equivalents will occur to those skilled in the art. For example, binder contact mechanisms having different geometry than those described above with reference to the preferred embodiment may be employed. Therefore, the above should not be construed as limiting the invention, which is defined by the appended claims.

What is claimed is:

1. A searchable binder operationally compatible with a binder management system having a binder cabinet with conductive shelf elements and a file cabinet with conductive support rails, said binder comprising:

a binder body having a front cover, a rear cover and a spine joining said front cover and said rear cover, said spine having upper and lower outer margins;

a binder mechanism mounted in the interior of said binder body;

a visible indicator mounted on said binder body in a position visible from the outside of the binder;

a pair of binder contact mechanisms secured to said spine at opposite ends thereof, each said binder contact mechanism having a base element and a sliding element slidably secured to said base element, said sliding element having a first stable position in which the sliding element extends a first distance beyond the associated one of said outer margins of said spine to enable engagement with one of the conductive shelf elements of the binder cabinet and a second stable position in which the sliding element extends a second distance beyond said associated one of said outer margins of said spine to enable engagement with one of the conductive support rails of the file cabinet, the conductive shelf elements and conductive support rails providing binder identification signals; and a binder identification circuit mounted on said binder body and coupled to at least one of said pair of binder contact mechanisms and said visible indicator for activating said visible indicator when a binder identification signal present on said at least one binder contact mechanism designates said binder as a sought binder.

2. The invention of claim 1 wherein said base element includes a pair of longitudinally spaced upstanding mutually aligned guide posts, an upstanding apertured guide flange having an aperture aligned with said guide posts, and a latch spring mounted adjacent an edge of said base element; and wherein said sliding element includes an outwardly extending contact flange located at a first end of said sliding element, a guide rod pivotally secured to a second opposite end of said sliding element and received in sliding engagement in said aperture of said guide flange, a bias spring received about said guide rod between said second opposite end of said sliding element and said guide flange of said base element, a longitudinally extending guide slot dimensioned to receive said pair of longitudinally spaced upstanding mutually aligned guide posts of said base element, and a latching notch formed in an edge of said sliding element in a position to engage said latch spring of said base element when said sliding element is in said first stable position.

3. The invention of claim 2 wherein one of said pair of mutually aligned guide posts has a smaller outer diameter than the other one of said mutually aligned guide posts so that said sliding element is capable of limited lateral movement sufficient to disengage said latch spring from said latching notch when said sliding element is subjected to a laterally directed force.

4. The invention of claim 2 wherein said guide rod is pivotally secured to said second opposite end of said sliding element by means of an apertured mounting tab secured to said guide rod and a rivet received in the aperture in said mounting tab.

5. The invention of claim 1 further including a mounting plate mounted on said spine; and wherein said pair of binder contact mechanisms and said binder identification circuit are carried by said mounting plate.

6. The invention of claim 1 wherein said binder identification signal comprises a binder address unique to the associated binder; and wherein said binder identification circuit includes an addressable decoder.

7. A searchable binder module for use with a binder body having a front cover, a rear cover and a spine joining said front cover and said rear cover, said spine having upper and lower outer margins, said module comprising:

a mounting plate dimensioned to be mounted on a binder body spine;

a visible indicator secured to said mounting plate;

a pair of binder contact mechanisms secured to said mounting plate at opposite ends thereof, each said binder contact mechanism having a base element and a sliding element slidably secured to said base element, said sliding element having a first stable position in which the sliding element extends a first distance beyond an associated one of the outer margins of the binder body spine when said mounting plate is mounted on the binder body spine and a second stable position in which the sliding element extends a second distance beyond the associated one of the outer margins of the binder body spine when said mounting plate is mounted on the binder body spine; and a binder identification circuit mounted on said mounting plate and coupled to at least one of said pair of binder contact mechanisms and said visible indicator for activating said visible indicator when a binder identification signal present on said at least one binder contact mechanism designates said binder as a sought binder.

8. The invention of claim 7 wherein said base element includes a pair of longitudinally spaced upstanding mutually aligned guide posts, an upstanding apertured guide flange having an aperture aligned with said guide posts, and a latch spring mounted adjacent an edge of said base element; and wherein said sliding element includes an outwardly extending contact flange located at a first end of said sliding element, a guide rod pivotally secured to a second opposite end of said sliding element and received in sliding engagement in said aperture of said guide flange, a bias spring received about said guide rod between said second opposite end of said sliding element and said guide flange of said base element, a longitudinally extending guide slot dimensioned to receive said pair of longitudinally spaced upstanding mutually aligned guide posts of said base element, and a latching notch formed in an edge of said sliding element in a position to engage said latch spring of said base element when said sliding element is in said first stable position.

9. The invention of claim 8 wherein one of said pair of mutually aligned guide posts has a smaller outer diameter than the other one of said mutually aligned guide posts so that said sliding element is capable of limited lateral movement sufficient to disengage said latch spring from said latching notch when said sliding element is subjected to a laterally directed force.

10. The invention of claim 8 wherein said guide rod is pivotally secured to said second opposite end of said sliding element by means of an apertured mounting tab secured to said guide rod and a rivet received in the aperture in said mounting tab.

11. The invention of claim 7 wherein said binder identification signal comprises a binder address unique to an associated binder body; and wherein said binder identification circuit includes an addressable decoder.

12. A contact mechanism for use with a binder body having a front cover, a rear cover and a spine joining the front cover and the rear cover, the spine having upper and lower outer margins, said contact mechanism comprising:

a base element having a pair of longitudinally spaced upstanding mutually aligned guide posts, an upstanding apertured guide flange having an aperture aligned with said guide posts, and a latch spring mounted adjacent an edge of said base element; and a sliding element slidably secured to said base element, said sliding element having a first stable position in which the sliding element contacts said latch spring and extends a first distance beyond an associated one of the outer margins of the binder body spine when said contact mechanism is mounted on the binder body spine and a second stable position in which the sliding element extends a second distance beyond the associated one of the outer margins of the binder body spine when the contact mechanism is mounted on the binder body spine.

13. The invention of claim 12 wherein said sliding element includes an outwardly extending contact flange located at a first end of said sliding element, a guide rod pivotally secured to a second opposite end of said sliding element and received in sliding engagement in said aperture of said guide flange, a bias spring received about said guide rod between said second opposite end of said sliding element and said guide flange of said base element, a longitudinally extending guide slot dimensioned to receive said pair of longitudinally spaced upstanding mutually aligned guide posts of said base element, and a latching notch formed in an edge of said sliding element in a position to engage said latch spring of said base element when said sliding element is in said first stable position.

14. The invention of claim 13 wherein one of said pair of mutually aligned guide posts has a smaller outer diameter than the other one of said mutually aligned guide posts so that said sliding element is capable of limited lateral movement sufficient to disengage said latch spring from said latching notch when said sliding element is subjected to a laterally directed force.

15. The invention of claim 13 wherein said guide rod is pivotally secured to said second opposite end of said sliding element by means of an apertured mounting tab secured to said guide rod and a rivet received in the aperture in said mounting tab.

* * * * *